US008512928B2

(12) United States Patent
Kishida et al.

(10) Patent No.: US 8,512,928 B2
(45) **Date of Patent: *Aug. 20, 2013**

(54) CARRIER FOR DEVELOPING ELECTROSTATIC LATENT IMAGE, AND TWO-COMPONENT DEVELOPER, SUPPLEMENTAL DEVELOPER, IMAGE FORMING APPARATUS, PROCESS CARTRIDGE, AND IMAGE FORMING METHOD USING THE CARRIER

(75) Inventors: Hiroyuki Kishida, Shizuoka (JP); Shigenori Yaguchi, Shizuoka (JP); Kimitoshi Yamaguchi, Shizuoka (JP); Toyoshi Sawada, Kanagawa (JP); Hiroshi Tohmatsu, Shizuoka (JP); Koichi Sakata, Shizuoka (JP); Hitoshi Iwatsuki, Shizuoka (JP); Toyoaki Tano, Shizuoka (JP); Mariko Takii, Shizuoka (JP)

(73) Assignee: Rocoh Company, Ltd., Tokyo (JP)

( * ) Notice: Subject to any disclaimer, the term of this patent is extended or adjusted under 35 U.S.C. 154(b) by 89 days.

This patent is subject to a terminal disclaimer.

(21) Appl. No.: 13/226,219

(22) Filed: Sep. 6, 2011

(65) Prior Publication Data

US 2012/0064451 A1 Mar. 15, 2012

(30) Foreign Application Priority Data

Sep. 14, 2010 (JP) ..... 2010-205083
Aug. 15, 2011 (JP) ..... 2011-177444

(51) Int. Cl.
*G03G 9/00* (2006.01)

(52) U.S. Cl.
USPC ..... 430/111.35; 430/111.1; 430/111.3; 430/111.31; 430/123.4

(58) Field of Classification Search
USPC ..... 430/111.1, 111.3, 111.31, 111.35, 430/123.4
See application file for complete search history.

(56) References Cited

U.S. PATENT DOCUMENTS

| | | | | |
|---|---|---|---|---|
| 7,381,513 | B2 | 6/2008 | Suzuki et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 2006/0194137 | A1* | 8/2006 | Kobayashi et al. | 430/111.31 |
| 2006/0210905 | A1 | 9/2006 | Imahashi et al. | |

(Continued)

FOREIGN PATENT DOCUMENTS

| | | |
|---|---|---|
| JP | 41-20153 | 11/1966 |
| JP | 42-1627 | 1/1967 |

(Continued)

OTHER PUBLICATIONS

U.S. Appl. No. 13/213,633, filed Aug. 19, 2011, Sakata, et al.

(Continued)

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

A carrier comprising a magnetic core particle having a shape factor SF-2 of 130 to 160 and a resin layer covering a surface of the magnetic core particle. The resin layer comprises a conductive particle and a resin obtained by heating a copolymer comprising a silicon-containing A unit and another silicon-containing B unit.

18 Claims, 1 Drawing Sheet

(56) References Cited

U.S. PATENT DOCUMENTS

| | | | | |
|---|---|---|---|---|
| 2007/0048652 | A1 | 3/2007 | Imahashi et al. | |
| 2008/0063969 | A1* | 3/2008 | Yamaguchi et al. | 430/110.2 |
| 2008/0096121 | A1 | 4/2008 | Iwatsuki et al. | |
| 2008/0152393 | A1 | 6/2008 | Nagayama et al. | |
| 2008/0213684 | A1 | 9/2008 | Nagayama et al. | |
| 2008/0227004 | A1 | 9/2008 | Yamaguchi et al. | |
| 2009/0092920 | A1 | 4/2009 | Nagayama et al. | |
| 2010/0233613 | A1 | 9/2010 | Masuda et al. | |
| 2010/0239975 | A1* | 9/2010 | Yamaguchi et al. | 430/111.35 |
| 2011/0065037 | A1 | 3/2011 | Iwatsuki et al. | |
| 2011/0086307 | A1* | 4/2011 | Nakajima et al. | 430/111.3 |
| 2011/0091802 | A1* | 4/2011 | Takahashi et al. | 430/108.3 |
| 2011/0171573 | A1 | 7/2011 | Sakata et al. | |
| 2011/0229817 | A1* | 9/2011 | Yamada et al. | 430/111.35 |
| 2012/0057898 | A1* | 3/2012 | Sakata et al. | 399/111 |

FOREIGN PATENT DOCUMENTS

| | | |
|---|---|---|
| JP | 43-27596 | 11/1968 |
| JP | 44-6397 | 3/1969 |
| JP | 45-26478 | 9/1970 |
| JP | 55-127569 | 10/1980 |
| JP | 55-42752 | 11/1980 |
| JP | 55-157751 | 12/1980 |
| JP | 56-140358 | 11/1981 |
| JP | 57-96355 | 6/1982 |
| JP | 57-96356 | 6/1982 |
| JP | 58-207054 | 12/1983 |
| JP | 59-7385 | 2/1984 |
| JP | 7-21654 | 3/1995 |
| JP | 7-120085 | 12/1995 |
| JP | 2801492 | 7/1998 |
| JP | 11-217389 | 8/1999 |
| JP | 3691115 | 6/2005 |
| JP | 3726592 | 10/2005 |
| JP | 2006-337828 | 12/2006 |
| JP | 2007-58124 | 3/2007 |
| JP | 4201932 | 10/2008 |

OTHER PUBLICATIONS

U.S. Appl. No. 13/181,702, filed Jul. 13, 2011, Yamaguchi, et al.
U.S. Appl. No. 13/037,569, filed Mar. 1, 2011, Saori Yamada, et al.

* cited by examiner

CARRIER FOR DEVELOPING ELECTROSTATIC LATENT IMAGE, AND TWO-COMPONENT DEVELOPER, SUPPLEMENTAL DEVELOPER, IMAGE FORMING APPARATUS, PROCESS CARTRIDGE, AND IMAGE FORMING METHOD USING THE CARRIER

CROSS-REFERENCE TO RELATED APPLICATIONS

This patent application is based on and claims priority pursuant to 35 U.S.C. §119 to Japanese Patent Application Nos. 2010-205083 and 2011-177444, filed on Sep. 14, 2010 and Aug. 15, 2011, respectively, in the Japan Patent Office, the entire disclosure of each of which is hereby incorporated herein by reference.

FIELD OF THE INVENTION

The present application relates to a carrier for developing electrostatic latent image, and a two-component developer, a supplemental developer, an image forming apparatus, a process cartridge, and an image forming apparatus using the carrier.

BACKGROUND OF THE INVENTION

In electrophotographic image formation, an electrostatic latent image is formed on an image bearing member comprising a photoconductive material, and the electrostatic latent image is developed into a toner image with a charged toner. The toner image is then transferred onto and fixed on a recording medium. In the field of electrophotography, full-color copiers and printers have been brought to the mainstream in place of monochrome copiers and printers recently.

In a typical full-color image formation, toner layers of yellow, magenta, cyan, and optional black are superimposed on one another to reproduce various colors, and the resulting composite toner image is finally fixed on a recording medium. To obtain a vivid full-color image which is precisely reproducing colors, the surface of the composite toner image fixed on the recording medium is preferably as smooth as possible so as to reduce light scattering. Thus, a typical full-color image has a middle to high image gloss level of 10 to 50%.

Typically, a toner image is fixed on a recording medium by pressing a heated roller or belt against the toner image on the recording medium. Such a fixing method may be called as contact heating fixing method. The contact heating fixing method provides high thermal efficiency and high-speed fixing, thus producing images with high gloss and transparency. However, because the heated roller or belt is pressed against the melted toner image and then separated therefrom, the method causes an undesirable phenomenon in which a part of the toner image is adhered to a surface of the roller or belt and retransferred onto another image. This phenomenon is hereinafter called as hot offset.

To prevent the occurrence of hot offset, there has been a proposal to form the surface of the roller or belt with a material having high separability (repellency) such as a silicone rubber or a fluorine-containing resin and further apply an offset preventing oil such as a silicone oil to the surface. This proposal has been widely employed. The offset preventing oil effectively prevents the occurrence of hot offset but requires an apparatus that applies the oil to the roller or belt. Therefore, the fixing device undesirably becomes larger and larger.

In view of this, toners for forming monochrome images have been developed to include a release agent and to express a large viscoelasticity when melted. Such toners can be used for fixing systems in which no oil or a slight amount of oil is applied to the fixing roller or belt (hereinafter "oilless fixing systems").

Recently, compact and simple oilless fixing systems are spreading in the field of full-color image formation technology as well as in the field of monochrome image formation technology. However, it is likely that hot offset more frequently occurs in full-color image formation because toners are designed to express a lower viscoelasticity when melted so that the fixed toner image has a smooth surface. Therefore, it is difficult to employ oilless fixing systems in full-color image formation. Disadvantageously, toner particles including a release agent are transferred onto a recording medium at a lower transfer rate due to their high adhesive property. Further, such toner particles may make thin films thereof on carrier particles (hereinafter "filming"), resulting in deterioration of chargeability and durability.

On the other hand, there have been various attempts to provide a low-surface-energy covering layer, comprised of a fluorine-based resin, a silicone resin, or the like, on a core material of carrier, for the purpose of preventing the occurrence of filming, forming a uniform carrier surface, preventing oxidation of the carrier surface, preventing deterioration of humidity resistance, extending the lifespan of two-component developer, preventing adherence of carrier to photoreceptor, protecting photoreceptor from scratch or abrasion, and controlling charge polarity and quantity.

On the other hand, disadvantageously, recent toners are more adhesive to carrier particles because they have a smaller particle diameter and are subjected to a higher-speed printing. Such toners further including a release agent are much more adhesive to carrier particles. In this case, toner charge is so reduced that toner scattering and background fouling easily occur.

When toner particles adhere to carrier particles or covering layers of the carrier particles are abraded or peeled off, electric resistance and toner supplying power of the carrier particles are changed. As a result, the resulting image density is changed, especially in highlight portions, and the resulting image is contaminated with fillers released from the covering layer, especially in yellow images.

In accordance with reduction in particle size of toner, carrier has been also reduced in particle size, which undesirably accelerates the occurrence of carrier deposition. To improve image quality, electric resistance and magnetization of carrier should be properly controlled, however, it is difficult to change them while maintaining compatibility with developing device in which the carrier is to be used.

Carrier deposition is a phenomenon in which carrier particles are adhered to an electrostatic latent image bearing member (e.g., photoreceptor) and then deposited on an image. Carrier deposition generally occurs in a whole area, a background area, or an image area. Carrier deposition occurred in a whole area is due to low magnetic force of carrier particles. Carrier deposition occurred in a background area is due to high resistance and large particle diameter of carrier particles. Such carrier particles are reversely charged to toner particles and thus reversely deposited. Carrier deposition occurred in an image area is due to low resistance of carrier particles. Such carrier particles are deposited together with toner particles because toner charge or developing charge is injected into the carrier particles. Lower-resistance carriers generally provide higher image quality, however, more cause carrier deposition due to charge injection. Thus, the occurrence of carrier deposition should be prevented by controlling the shape of carrier particles.

For example, carrier particles substantially having a spherical shape have been proposed to prevent carrier deposition.

However, there is a possibility that the covering layer causes blocking or deteriorates durability. Moreover, carrier resistance cannot be well controlled only by carrier shape.

BRIEF SUMMARY OF THE INVENTION

Exemplary aspects of the present invention are put forward in view of the above-described circumstances, and provide a novel carrier for developing electrostatic latent image that provides high quality images and high durability without causing carrier deposition while maintaining proper resistance and magnetization.

In one exemplary embodiment, a novel carrier comprises a magnetic core particle having a shape factor SF-2 of 130 to 160 and a resin layer covering a surface of the magnetic core particle. The resin layer comprises a conductive particle and a resin obtained by heating a copolymer comprising a monomer A unit having the following formula (1) and a monomer B unit having the following formula (2):

(1)

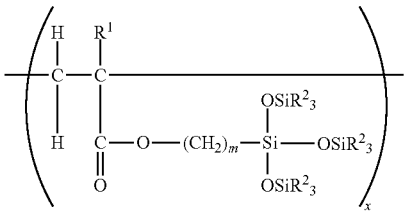

Monomer A unit (2)

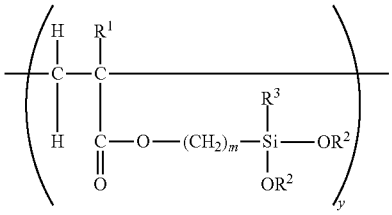

Monomer B unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, and each of X and Y represents a molar ratio (%) between 10 to 90.

DETAILED DESCRIPTION OF THE INVENTION

Figure 1:
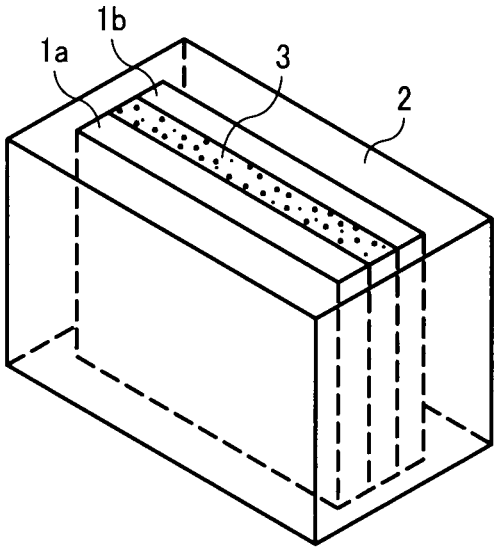
FIG. 1 is a schematic view illustrating a measuring cell for measuring volume resistivity of carriers.

Exemplary aspects of the present invention provides a carrier for developing electrostatic latent image, comprising a magnetic core particle and a resin layer that covers a surface of the magnetic core particle. The magnetic core particle has a shape factor SF-2 of 130 to 160. The resin layer includes a conductive particle and a resin obtained by heating a copolymer comprising a monomer A unit having the following formula (1) and a monomer B unit having the following formula (2):

(1)

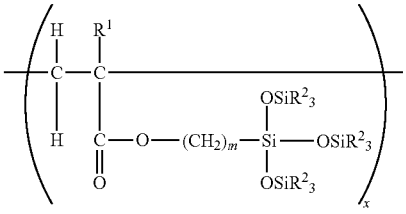

Monomer A unit (2)

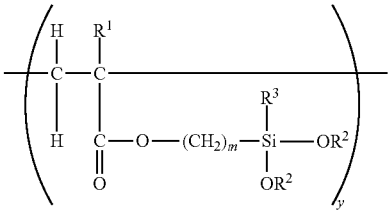

Monomer B unit

The carrier can be obtained by covering the magnetic core particle having an SF-2 of 130 to 160 with an acrylic copolymer, which may be represented by the following formula (3), obtained by radical-copolymerizing monomers A and B and an optional monomer C, hydrolyzing the acrylic copolymer to produce silanol groups, condensing the silanol groups with a titanium diisopropoxybis(ethyl acetoacetate) catalyst to form cross-links, and heating the core particle.

(3)

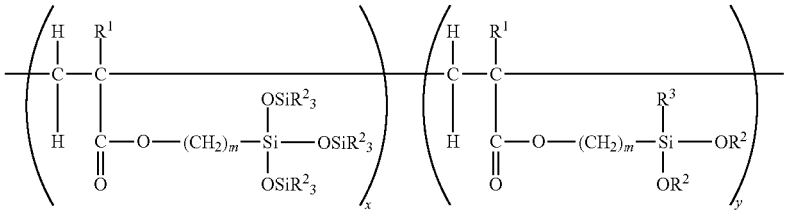

Monomer A unit Monomer B unit

In the formulae (1) to (3), $R^1$ represents a hydrogen atom or a methyl group, m represents an integer of 1 to 8 (i.e., $(CH_2)_m$ represents an alkylene group such as methylene group, ethylene group, propylene group, and butylene group), $R^2$ represents an alkyl group having 1 to 4 carbon atoms (e.g., methyl group, ethyl group, propyl group, isopropyl group, butyl group), and $R^3$ represents an alkyl group having 1 to 8 carbon atoms (e.g., methyl group, ethyl group, propyl group, isopropyl group, butyl group) or an alkoxy group having 1 to 4 carbon atoms (e.g., methoxy group, ethoxy group, propoxy group, butoxy group).

Thus, the carrier has a strong covering layer comprised of low-surface-energy silane-based cross-linked components and the conductive particle, which is resistant to abrasion, peeling, and toner adherence. The carrier also keeps proper resistivity and developer feed rate, providing high quality images for an extended period of time. Also, the carrier keeps proper charging ability regardless of environmental condition, thus providing high quality images without image density variation, background fouling, and toner scattering in any environmental condition.

First, the monomer A unit is described in detail below.

(1)

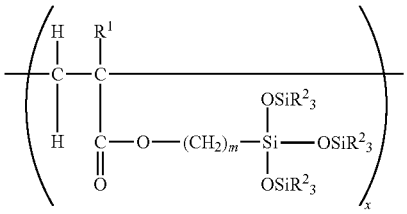

Monomer A unit

In the formula (1), $R^1$ represents a hydrogen atom or a methyl group, m represents an integer of 1 to 8 (i.e., $(CH_2)_m$ represents an alkylene group such as methylene group, ethylene group, propylene group, and butylene group), $R^2$ represents an alkyl group having 1 to 4 carbon atoms (e.g., methyl group, ethyl group, propyl group, butyl group), and X represents a molar ratio (%) between 10 and 90, more preferably 30 and 70.

The monomer A unit has a tris(trimethylsiloxy)silane that is an atom group having multiple methyl groups on side chains. As the ratio of the monomer a unit increases in the resin, the surface energy of the resulting carrier becomes lower. A carrier having such a low surface energy is less adhesive to binder resin and/or wax of toner. When the molar ratio of the monomer A unit is too small, binder resin and/or wax of toner may considerably adhere to the resulting carrier. When the molar ratio of the monomer A unit is too large, the molar ratio of the monomer B unit is too small, and therefore the resin layer may have poor toughness and the adherence between the core particle and the resin layer may be too weak, degrading durability of the resulting carrier.

$R^2$ represents an alkyl group having 1 to 4 carbon atoms. Thus, specific examples of the monomer A include, but are not limited to, tris(trialkylsiloxy)silane compounds represented by the following formulae in which Me, Et, and Pr respectively represents methyl group, ethyl group, and propyl group.

$CH_2{=}CMe\text{-}COO{-}C_3H_6{-}Si(OSiMe_3)_3$
$CH_2{=}CH{-}COO{-}C_3H_6{-}Si(OSiMe_3)_3$
$CH_2{=}CMe\text{-}COO{-}C_4H_8{-}Si(OSiMe_3)_3$
$CH_2{=}CMe\text{-}COO{-}C_3H_6{-}Si(OSiEt_3)_3$
$CH_2{=}CH{-}COO{-}C_3H_6{-}Si(OSiEt_3)_3$
$CH_2{=}CMe\text{-}COO{-}C_4H_8{-}Si(OSiEt_3)_3$
$CH_2{=}CMe\text{-}COO{-}C_3H_6{-}Si(OSiPr_3)_3$
$CH_2{=}CH{-}COO{-}C_3H_6{-}Si(OSiPr_3)_3$
$CH_2{=}CMe\text{-}COO{-}C_4H_8{-}Si(OSiPr_3)_3$ The monomer A may be obtained by, for example, reacting a tris(trialkylsiloxy)silane with aryl acrylate or aryl methacrylate in the presence of a platinum catalyst, or reacting methacryloxyalkyl trialkoxysilane with hexaalkyl disiloxane in the presence of a carboxylic acid and an acid catalyst as described in Japanese Patent Application Publication No. 11-217389, the disclosure thereof being incorporated herein by reference.

Next, the monomer B unit is described in detail below.

(2)

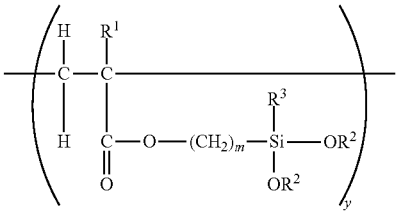

Monomer B unit

In the formula (2), $R^1$ represents a hydrogen atom or a methyl group, m represents an integer of 1 to 8 (i.e., $(CH_2)_m$ represents an alkylene group such as methylene group, ethylene group, propylene group, and butylene group), $R^2$ represents an alkyl group having 1 to 4 carbon atoms (e.g., methyl group, ethyl group, propyl group, butyl group), $R^3$ represents an alkyl group having 1 to 8 carbon atoms (e.g., methyl group, ethyl group, propyl group, butyl group) or an alkoxy group having 1 to 4 carbon atoms (e.g., methoxy group, ethoxy group, propoxy group, butoxy group), and Y represents a molar ratio (%) between 10 and 90, more preferably 30 and 70. Thus, the monomer B is a radical-polymerizable difunctional or trifunctional silane compound.

When the molar ratio of the monomer B unit is too small, the resin layer may have poor toughness. When the molar ratio of the monomer B unit is too large, the resin layer may be so stiff and brittle that abrasion may be caused. Additionally, environmental stability (humidity dependence) may be poor because a large number of silanol groups generated from hydrolyzed cross-linked components may remain.

Specific examples of the monomer B include, but are not limited to, 3-methacryloxypropyl trimethoxysilane, 3-acryloxypropyl trimethoxysilane, 3-methacryloxypropyl triethoxysilane, 3-acryloxypropyl triethoxysilane, 3-methacryloxypropyl methyldimethoxysilane, 3-methacryloxypropyl methyldiethoxysilane, 3-methacryloxypropyl tri(isopropoxy)silane, and 3-acryloxypropyl tri(isopropoxy)silane.

To accelerate condensation reaction of the monomer B unit, titanium-based catalysts, tin-based catalysts, zirconium-based catalysts, or aluminum-based catalysts can be used. Among these catalysts, titanium-based catalysts are preferable. More specifically, titanium diisopropoxybis(ethyl acetoacetate) is preferable. The above catalysts effectively accelerate condensation reaction of silanol group derived from the monomer B unit, while keeping good catalytic ability. The titanium diisopropoxybis(ethyl acetoacetate) has the following formula:

$Ti(O\text{-}i\text{-}C_3H_7)_2(C_6H_9O_3)_2$

In attempting to improve durability of carrier, there has been a proposal to form a cross-linked resin layer on a core particle. For example, Japanese Patent No. 3691115 describes a carrier having a covering layer including a thermosetting resin obtained by cross-linking a copolymer of an organopolysiloxane having a terminal vinyl group and a radical-polymerizable monomer having at least one of hydroxyl group, amino group, amide group, and imide group, with an isocyanate compound. However, this carrier is not resistant to peeling off or abrasion of the resin layer.

This is because the number of functional groups per unit weight of the copolymer to be cross-linked with the isocyanate compound is too small to form two-dimensional or three-dimensional dense cross-linking structure. Such a resin layer may peel off from the core particle or may be abraded after a long term of use.

Peeing off or abrasion of the resin layer reduces resistance of the carrier, resulting in poor-quality image with carrier deposition. Peeing off or abrasion of the resin layer also reduces fluidity of developer, resulting in poor-quality image with low image density, background fouling, and/or toner scattering.

The copolymer according to exemplary embodiments includes about 2 to 3 times the number of difunctional or trifunctional cross-linkable functional groups per unit weight than the above resin, and is further subjected to cross-linking by condensation polymerization. Thus, the resulting resin layer is tough and not abraded. Additionally, siloxane cross-linking bonds have greater binding energy and are more resistant to thermal stress than isocyanate cross-linking bonds, providing better temporal stability.

To improve flexibility and adhesiveness between the core particle and the resin layer and between the resin layer and the conductive particle, the copolymer may further include a monomer C unit having the following formula (4):

(4)

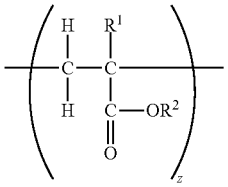

Monomer C unit

In the formula (4), $R^1$ represents a hydrogen atom or a methyl group and $R^2$ represents an alkyl group having 1 to 4 atoms. When the copolymer has the monomer C unit, preferably, the molar ratio X (%) of the monomer A unit is 10 to 40%; the molar ratio Y (%) of the monomer B unit is 10 to 40%; the molar ratio Z (%) of the monomer C unit is 30 to 80%, more preferably 35 to 75%; and $60\%<Y+Z<90\%$, more preferably $70\%<Y+Z<85\%$, is satisfied. When the molar ratio Z(%) of the monomer C unit is too large, the molar ratio X (%) of the monomer A unit or the molar ratio Y (%) of the monomer B unit becomes too small. As a result, the resulting resin layer cannot achieve a good balance between repellency, stiffness, and flexibility.

Specific examples of acrylic compounds suitable for the monomer C include, but are not limited to, acrylates and methacrylates such as methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate, and 2-(diethylamino)ethyl acrylate. Among these compounds, alkyl methacrylates are preferable and methyl acrylate is most preferable. Two or more of these compounds can be used in combination.

Thus, the resin layer can be formed from a resin layer composition including a solvent, a silicone resin having a silanol group and/or a hydrolyzable functional group, a titanium diisopropoxybis(ethyl acetoacetate) catalyst, and optional resins, for example.

The resin layer may be formed by subjecting silanol groups to condensation reaction by applying heat or light, while the core particle is covered with the resin layer composition. Alternatively, the resin layer may be formed by subjecting silanol groups to condensation reaction by applying heat, after the core particles has been covered with the resin layer composition. The heating temperature is preferably 80 to 400° C.

The resin layer may further include another resin in addition to the silicone resin having a silanol group and/or a hydrolyzable functional group. Specific examples of usable resins include, but are not limited to, acrylic resins, amino resins, polyvinyl resins, polystyrene resins, halogenated olefin resins, polyester resins, polycarbonate resins, polyethylene resins, polyvinyl fluoride resins, polyvinylidene fluoride resins, poly(trifluoroethylene) resins, poly(hexafluoropropylene) resins, copolymer of vinylidene fluoride and vinyl fluoride, fluoroterpolymer (e.g., terpolymer of tetrafluoroethylene, vinylidene fluoride, and a non-fluoride monomer), and silicone resins having no silanol group and/or no hydrolyzable functional group. Two or more of these resins can be used in combination. Among these resins, acrylic resins are preferable because they are adhesive to the core particle and conductive particle while being less brittle.

The acrylic resin preferably has a glass transition temperature of 20 to 100° C., more preferably 25 to 80° C. Such an acrylic resin has proper elasticity. When the carrier frictionally charges toner, the resin layer receives strong impact due to friction between toner particle and carrier particle, or between carrier particles. The acrylic resin having proper elasticity absorbs the impact and thus prevents deterioration of the resin layer even when the resin layer is made thin.

Further, the resin layer preferably includes a cross-linked material between an acrylic resin and an amino resin. Such a resin layer has proper elasticity and prevents fusion between resin layers.

Specific examples of usable amino resins include, but are not limited to, melamine resins and benzoguanamine resins, which can improve charge giving ability of the resulting carrier. To more properly control the charge giving ability of the resulting carrier, a melamine resin and/or a benzoguanamine resin are/is preferably used in combination with another amino resin.

Acrylic resins which form cross-links between the amino resins preferably include a hydroxyl group and/or a carboxyl group, more preferably a hydroxyl group. In this case, both adhesiveness between the resin layer and the core particle or conductive particle, and dispersion stability of the conductive particle are improved. The acrylic resin preferably has a hydroxyl value of 10 mgKOH/g or more, and more preferably 20 mgKOH/g or more.

The resin layer includes a conductive particle. Specific preferred examples of suitable conductive particle include, but are not limited to, carbon black, indium tin oxide (ITO), tin oxide, and zinc oxide. Two or more of these materials can be used in combination. Among these materials, ITO is preferable. Although the reason why ITO is preferred is still not clarified, a conductive particle comprised of tin oxide having a conductive layer on its surface has high ability to control volume resistivity of the carrier. This is because such a conductive particle has high compatibility with the copolymer having a low surface energy and high toughness. Thus, the carrier can keep constant resistivity and toner supplying ability for an extended period of time.

The content of the conductive particle is preferably 0.1 to 1,000% by weight based on the silicone resin. When the amount of the conductive particle is too small, the resistance of the carrier cannot be well controlled. When the amount of the conductive particle is too large, the conductive particle may easily release from the carrier.

The resin layer preferably includes a silane coupling agent to reliably disperse the conductive particle.

Specific examples of usable silane coupling agents include, but are not limited to, γ-(2-aminoethyl)aminopropyl trimethoxysilane, γ-(2-aminoethyl)aminopropylmethyl dimethoxysilane, γ-methacryloxypropyl trimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethyl disilazane, γ-anilinopropyl trimethoxysilane, vinyl trimethoxysilane, octadecyldimethyl[3-(trimethoxysilyl)propyl]ammonium chloride, γ-chloropropylmethyl dimethoxysilane, methyl trichlorosilane, dimethyl dichlorosilane, trimethyl chlorosilane, allyl triethoxysilane, 3-aminopropylmethyl diethoxysilane, 3-aminopropyl trimethoxysilane, dimethyl diethoxysilane, 1,3-divinyltetramethyl disilazane, and methacryloxyethyldimethyl(3-trimethoxysilylpropyl) ammonium chloride. Two or more of these materials can be used in combination.

Specific examples of commercially-available silane coupling agents include, but are not limited to, AY43-059, SR6020, SZ6023, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (from Dow Corning Toray Co., Ltd.).

The content of the silane coupling agent is preferably 0.1 to 10% by weight based on the silicone resin. When the content of the silane coupling agent is too small, adhesiveness between the silicone resin and the core particle or conductive particle may be poor. When the content of the silane coupling agent is too large, toner filming may occur in a long-term use.

The resin layer completely covers the core particle without deficiency, and preferably has an average thickness of 0.05 to 0.50 μm. When the average thickness is too small, the resin layer may be easily destroyed or abraded. When the average thickness is too large, the carrier may easily adhere to images because the resin layer has no magnetic property, and the resistance cannot be well controlled.

The core particle of the carrier is a magnetic material. Specific preferred examples of suitable magnetic materials for the core particle include, but are not limited to, ferromagnetic materials (e.g., iron, cobalt), iron oxides (e.g., magnetite, hematite, ferrite), alloys, and resin particles in which magnetic materials are dispersed. Among these materials, Mn ferrite, Mn—Mg ferrite, and Mn—Mg—Sr ferrite are preferable because they are environmentally-friendly.

Thus, the carrier has a strong covering layer comprised of low-surface-energy silane-based cross-linked components and the conductive particle, which is resistant to abrasion, peeling, and toner adherence. The carrier also keeps proper resistivity and developer feed rate, providing high quality images for an extended period of time.

The core particle has a shape factor SF-2 of 130 to 160, and more preferably 135 to 145. When SF-2 is too small, the carrier resistance is so high that carrier deposition may occur on edge portions, which degrades image quality, although the carrier can keep good durability. When SF-2 is too large, convex portions on the carrier particles may be considerably abraded by contact with each other, degrading durability. Because the core particle properly has concavities and convexities on its surface, the resin layer is made thin in some potions on the surface. Thus, the resistance of the core particle can act on the resistance of the carrier due to the existence of such portions, while the stiff low-surface-energy resin layer keeps good durability of the carrier. The core particle having the above-described SF-2 value provides high-quality image without carrier deposition because the resin layer, even made thin, is not abraded for an extended period of time.

The shape factor SF-2 represents the degree of surface roughness and sphericity of the core particle. When the core particle is a true sphere, the SF-2 is 100. As surface roughness gets larger, the SF-2 also gets larger. The shape factor SF-2 is represented by the following formula:

$$(ML^2/A)\times(1/4\pi)\times 100$$

wherein ML and A respectively represents a peripheral length and an area of a projected image of the core particle.

The SF-2 can be measured by obtaining an image of 50 or more core particles magnified 1,000 times with an optical microscope, incorporating the image in an image analyzer (LUZEX III from Nireco Corporation) at a scanner resolution of 200 dpi, measuring peripheral lengths and areas of the core particles to determine the average SF-2.

The shape of the core particle can be controlled in the process of manufacturing the core particle. If raw materials are inhomogeneously mixed, the resulting core particle may have an inhomogeneous inner structure in which grain boundaries have a large size distribution, which makes an effect on the shape of the core particle. In a burning process, the grain boundaries may grow inhomogeneously and make an effect on the shape of the core particle unless the burning temperature is strictly controlled. In a granulation process, several (2 to 3) particles may coalesce and result in a product far away from a sphere. Thus, the surface structure of the core particle can be adjusted by controlling the core manufacturing conditions.

More specifically, the SF-2 of the core particle can be adjusted by controlling the burning temperature and burning time. The higher the burning temperature or the longer the burning time, the smaller the SF-2, because the grain boundaries more grow to smooth the surface. By contrast, the lower the burning temperature or the shorter the burning time, the greater the SF-2 (i.e., the surface is rough).

The core particle preferably has a weight average particle diameter of 20 to 65 μm. When the weight average particle diameter is too small, carrier deposition may occur. When the weight average particle diameter is too large, the resulting image may not precisely reproduce thin lines.

The weight average particle diameter of the core particle can be measured by a Microtrac particle size analyzer HRA9320-X100 (from Nikkiso Co., Ltd.).

The carrier preferably has a magnetization of 40 to 90 $Am^2/kg$ in a magnetic field of 1 kOe ($10^6/4\pi$[A/m]). When the magnetization is too small, carrier deposition may occur.

When the magnetization is too large, the magnetic brush may be so stiff that the resulting image has blurring.

The magnetization can be measured by an instrument High Sensitivity Vibrating Sample Magnetometer VSM-P7-15 (from Toei Industry Co., Ltd.).

The carrier preferably has a volume resistivity of $1\times10^9$ Ω·cm to $1\times10^{17}$ Ω·cm. When the volume resistivity is too small, carrier deposition may occur in non-image portions. When the volume resistivity is too large, an unacceptable degree of the edge effect may occur.

The volume resistivity can be measured using a measuring cell illustrated in FIG. 1 as follows. The measuring cell is comprised of a fluorocarbon-resin container 2, in which electrodes 1*a* and 1*b* each having a surface area of 2.5 cm×4 cm are facing at a distance of 0.2 cm. The measuring cell is filled with the carrier 3 and tapped from a height of 1 cm for 10 times at a tapping speed of 30 times/min. Thereafter, a direct current voltage of 1,000 V is applied to between the electrodes 1*a* and 1*b* for 30 seconds to measure a resistance r (Ω) by a high resistance meter 4329A (from Hewlett-Packard Japan. Ltd.). A volume resistivity (Ω·cm) is calculated from the following equation:

$$r\times(2.5\times4)/0.2$$

The developer according to the present invention includes the above-described carrier according to the present invention and a toner. The toner includes a binder resin and a colorant. The toner may be either a monochrome toner for producing monochrome images or a full-color toner for producing full-color images. The toner may further include a release agent so as to be usable in oilless fixing systems in which no oil is applied to a fixing member. Although such a toner including a release agent easily causes filming, the carrier according to the present invention can prevent the occurrence of filming. Therefore, the developer according to the present invention can provide high-quality images for an extended period of time. Because the carrier according to the present invention prevents peeling off of the resin layer, even yellow images may not be contaminated.

The toner can be manufactured by known methods such as pulverization methods and polymerization methods. In a typical pulverization method, raw materials are melt-kneaded and cooled, the melt-kneaded mixture is pulverized into particles, and the particles are classified by size to prepare mother particles. Further, an external additive is externally added to the mother particles to improve transferability and durability.

Specific examples of usable kneaders include, but are not limited to, a batch-type double roll mill; Banbury mixer; double-axis continuous extruders such as TWIN SCREW EXTRUDER KTK (from Kobe Steel, Ltd.), TWIN SCREW COMPOUNDER TEM (from Toshiba Machine Co., Ltd.), MIRACLE K.C.K (from Asada Iron Works Co., Ltd.), TWIN SCREW EXTRUDER PCM (from Ikegai Co., Ltd.), and KEX EXTRUDER (from Kurimoto, Ltd.); and single-axis continuous extruders such as KONEADER (from Buss Corporation). The cooled melt-kneaded mixture is pulverized into coarse particles by a hammer mill or a roatplex, and the coarse particles are pulverized into fine particles by a jet-type pulverizer or a mechanical pulverizer. Preferably, the pulverization condition is set so that toner particles having an average particle diameter of 3 to 15 μm are obtained.

The pulverized particles may be classified by a wind-power classifier. Preferably, the classification condition is set so that mother particles having an average particle diameter of 5 to 20 μm are collected. The external additive and the mother particles are mixed and agitated by a mixer so that the external additive is adhered to the surfaces of the mother particles while being pulverized by the agitation.

Specific examples of usable binder resins, but are not limited to, homopolymers of styrene or styrene derivatives (e.g., polystyrene, poly-p-styrene, polyvinyl toluene), styrene-based copolymers (e.g., styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, styrene-acrylonitrile-indene copolymer, styrene-maleate copolymer), polymethyl methacrylate, polybutyl methacrylate, polyvinyl chloride, polyvinyl acetate, polyethylene, polyester, polyurethane, epoxy resin, polyvinyl butyral, polyacrylic acid, rosin, modified rosin, terpene resin, phenol resin, aliphatic or aromatic hydrocarbon resin, and aromatic petroleum resin. Two or more of these resins can be used in combination.

Additionally, the following binder resins for pressure fixing can also be used: polyolefin resins (e.g., low-molecular-weight polyethylene, low-molecular-weight polypropylene), olefin copolymers (e.g., ethylene-acrylic acid copolymer, ethylene-acrylate copolymer, styrene-methacrylic acid copolymer, ethylene-methacrylate copolymer, ethylene-vinyl chloride copolymer, ethylene-vinyl acetate copolymer, ionomer resin), epoxy resin, polyester resin, styrene-butadiene copolymer, polyvinyl pyrrolidone, methyl vinyl ether-malic acid anhydride copolymer, maleic-acid-modified phenol resin, and phenol-modified terpene resin. Two or more of these resins can be used in combination.

Specific examples of usable colorants (e.g., pigments, dyes) include, but are not limited to, yellow colorants such as Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake; orange colorants such as Molybdenum Orange, Permanent Orange GTR, Pyrazolone Orange, Vulcan Orange, Indanthrene Brilliant Orange RK, Benzidine Orange G, and Indanthrene Brilliant Orange GK; red colorants such as Colcothar, Cadmium Red, Permanent Red 4R, Lithol Red, Pyrazolone Red, Watching Red Calcium Salt, Lake Red D, Brilliant Carmine 6B, Eosin Lake, Rhodamine Lake B, Alizarine Lake, and Brilliant Carmine 3B; violet colorants such as Fast Violet B and Methyl Violet Lake; blue colorants such as Cobalt Blue, Alkali Blue, Victoria Blue Lake, Phthalocyanine Blue, Metal-free Phthalocyanine Blue, Phthalocyanine Blue Partial Chloride, Fast Sky Blue, and Indanthrene Blue BC; green colorants such as Chrome Green, Chrome Oxide, Pigment Green B, and Malachite Green Lake; and black pigments such as azine dyes (e.g., Carbon Black, Oil Furnace Black, Channel Black, Lamp Black, Acetylene Black, Aniline Black), metal salt azo dyes, metal oxides, and complex metal oxides. Two or more of these colorants can be used in combination.

Specific examples of usable release agents include, but are not limited to, polyolefins (e.g., polyethylene, polypropylene), fatty acid metal salts, fatty acid esters, paraffin waxes, amide waxes, polyvalent alcohol waxes, silicone varnishes, carnauba waxes, and ester waxes. Two or more of these materials can be used in combination.

The toner may further include a charge controlling agent. Specific examples of usable charge controlling agents include, but are not limited to, nigrosine dyes, azine dyes having an alkyl group having 2 to 16 carbon atoms described in Examined Japanese Application Publication No. 42-1627, the disclosures thereof being incorporated herein by reference; basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 4 (C. I. 42000)) and lake pigments thereof; quaternary ammonium salts (e.g., C. I. Solvent Black 8 (C. I. 26150), benzoylmethylhexadecyl ammonium chloride, decyltrimethyl chloride); dialkyl (e.g., dibutyl, dioctyl) tin compounds; dialkyl tin borate compounds; guanidine derivatives; polyamine resins (e.g., vinyl polymers having amino group, condensed polymers having amino group); metal complex salts of monoazo dyes described in Examined Japanese Application Publication Nos. 41-20153, 43-27596, 44-6397, and 45-26478, the disclosures thereof being incorporated herein by reference; metal complexes of salicylic acid, dialkyl salicylic acid, naphthoic acid, and dicarboxylic acid with Zn, Al, Co, Cr, and Fe, described in Examined Japanese Application Publication Nos. 55-42752 and 59-7385, the disclosures thereof being incorporated herein by reference; sulfonated copper phthalocyanine pigments; organic boron salts; fluorine-containing quaternary ammonium salts; and calixarene compounds. Two or more of these materials can be used in combination. Preferably, the toners having colors other than black include a white metal salt of a salicylic acid derivative.

Specific examples of usable external additives include, but are not limited to, inorganic particles of silica, titanium oxide, alumina, silicon carbide, silicon nitride, and boron nitride; and resin particles of polymethyl methacrylate and polystyrene having an average particle diameter of 0.05 to 1 μm, which are obtained by soap-free emulsion polymerization. Two or more of these materials can be used in combination. Among these materials, hydrophobized metal oxides such as silica and titanium oxide are preferable. When a hydrophobized silica and a hydrophobized titanium oxide are used in combination and the amount of the hydrophobized titanium oxide is greater than that of the hydrophobized silica, the toner has excellent charge stability regardless of humidity.

The carrier may be used for a supplemental developer that is supplied to a developing device while a deteriorated developer is discharged therefrom. Because deteriorated carrier particles are replaced with fresh carrier particles included in the supplemental developer, toner particles are reliably charged and images are stably produced for an extended period of time. The use of supplemental developer is effective when printing an image having a high area occupancy. When printing an image having a high area occupancy, carrier particles are deteriorated by adherence of toner particles while a large amount of supplemental carrier particles are supplied. Thus, the frequency of replacing deteriorated carrier particles with fresh carrier particles is increased and images are stably produced for an extended period of time. The supplemental developer preferably includes a toner in an amount of 2 to 50 parts by weight based on 1 part by weight of the carrier. When the amount of toner is too small, toner particles may be excessively charged because an excessive amount of the carrier particles exist in a developing device. Because the excessively charged toner particles have poor developing power, the resulting image density may deteriorate. When the amount of toner is too large, the frequency of replacing deteriorated carrier particles with fresh carrier particles is reduced.

The image forming method according to exemplary aspects of the invention includes: forming an electrostatic latent image on an electrostatic latent image bearing member; developing the electrostatic latent image into a toner image by a developer; transferring the toner image from the electrostatic latent image bearing member onto a recording medium; and fixing the toner image on the recording medium.

Figure 2:
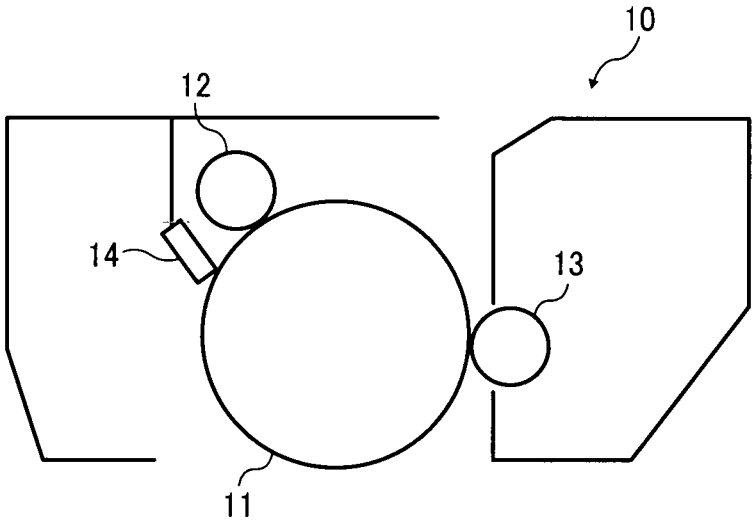
FIG. 2 is a schematic view illustrating a process cartridge according to exemplary embodiments of the invention.

FIG. 2 is a schematic view illustrating a process cartridge according to exemplary embodiments of the invention. A process cartridge 10 includes a photoreceptor 11; a charger 12 that charges the photoreceptor 11; a developing device 13 that develops an electrostatic latent image formed on the photoreceptor 11 into a toner image with the developer according to the present invention; and a cleaner 14 that removes residual toner particles remaining on the photoreceptor 11 after the toner image is transferred from the photoreceptor 11 onto a recording medium. The process cartridge 10 is detachably attachable to image forming apparatuses such as copiers and printers.

An image forming apparatus including the process cartridge 10 forms images in the following procedures. The photoreceptor 11 is driven to rotate at a predetermined peripheral speed. A peripheral surface of the photoreceptor 11 is uniformly charged to a predetermined positive or negative potential by the charger 12. The charged peripheral surface of the photoreceptor 11 is irradiated with a light beam emitted from an irradiator (e.g., slit irradiator, scanning irradiator) to form an electrostatic latent image. The electrostatic latent image formed on the peripheral surface of the photoreceptor 11 is developed into a toner image with the developer according to the present invention by the developing device 13. The toner image formed on the peripheral surface of the photoreceptor 11 is transferred onto a transfer paper that is fed to between the photoreceptor 11 and a transfer device from a paper feed part in synchronization with rotation of the photoreceptor 11. The transfer paper having the toner image thereon is separated from the peripheral surface of the photoreceptor 11 and introduced into a fixing device so that the toner image is fixed on the transfer paper. Thus, a copy is discharged from the image forming apparatus. The cleaner 14 removes residual toner particles remaining on the peripheral surface of the photoreceptor 11 after the toner has been transferred from the photoreceptor 11. The cleaned photoreceptor 11 is neutralized by a neutralizer to be ready for a next image forming operation.

The image forming apparatus according to exemplary aspects of the invention includes: an electrostatic latent image bearing member; a charger that charges the electrostatic latent image bearing member; an irradiator that forms an electrostatic latent image on the electrostatic latent image bearing member; a developing device that develops the electrostatic latent image into a toner image by the developer according to the present invention; a transfer device that transfers the toner image from the electrostatic latent image bearing member onto a recording medium; and a fixing device that fixes the toner image on the recording medium. The image forming apparatus may further include a neutralizer, a cleaner, a recycler, a controller, and the like.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Core Particle Manufacturing Example 1

A mixture of 73 parts of $Fe_2O_3$, 3 parts of $MnO_2$, and 4 parts of $Mg(OH)_2$ was subjected to mixing and pulverization for 24 hours using a wet-type ball mill, followed by drying by a spry dryer. The resulting particles were burnt at 900° C. for 23 hours using a rotary kiln, followed by pulverization and classification. Thus, a core particle C1 was prepared.

Core Particle Manufacturing Example 2

The procedure for preparing the core particle C1 was repeated except that the mixing and pulverization time was changed to 19 hours. Thus, a core particle C2 was prepared.

Core Particle Manufacturing Example 3

The procedure for preparing the core particle C1 was repeated except that the mixing and pulverization time was changed to 10 hours. Thus, a core particle C3 was prepared.

Core Particle Manufacturing Example 4

The procedure for preparing the core particle C1 was repeated except that the mixing and pulverization time was changed to 25 hours. Thus, a core particle C4 was prepared.

Core Particle Manufacturing Example 5

The procedure for preparing the core particle C1 was repeated except that the mixing and pulverization time was changed to 9 hours. Thus, a core particle C5 was prepared.

Resin Manufacturing Example 1

Monomer A:Monomer B=90:10

A flask equipped with a stirrer was charged with 500 g of toluene and heated to 90° C. under nitrogen gas flow. A mixture of 379.8 g (i.e., 900 mmol) of 3-methacryloxypropyl tris(trimethylsiloxy)silane represented by $CH_2{=}CMe\text{-}COO{-}C_3H_6{-}Si(OSiMe_3)_3$ (Me: methyl group) (SILAPLANE TM-0701T from Chisso Corporation), 24.8 g (i.e., 100 mmol) of 3-methacryloxypropyl trimethoxysilane, and 0.58 g (i.e., 3 mmol) of 2,2'-azobis-2-methylbutylonitrile was dropped in the flask over a period of 1 hour. Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The mixture was then agitated for 3 hours at 90 to 100° C. to be subjected to radical polymerization. Thus, a resin 1 that is a methacrylic copolymer was prepared. The resin 1 had a weight average molecular weight of 37,000. The resin 1 was diluted with toluene so that the diluted solution had 25% by weight of nonvolatile contents. The diluted toluene solution of the resin 1 had a viscosity of 8.4 $mm^2/s$ and a specific weight of 0.92.

Resin Manufacturing Example 2

Monomer A:Monomer B=10:90

A flask equipped with a stirrer was charged with 500 g of toluene and heated to 90° C. under nitrogen gas flow. A mixture of 42.2 g (i.e., 100 mmol) of 3-methacryloxypropyl tris(trimethylsiloxy)silane represented by $CH_2{=}CMe\text{-}COO{-}C_3H_6{-}Si(OSiMe_3)_3$ (Me: methyl group) (SILAPLANE TM-0701T from Chisso Corporation), 223.2 g (i.e., 900 mmol) of 3-methacryloxypropyl trimethoxysilane, and 0.58 g (i.e., 3 mmol) of 2,2'-azobis-2-methylbutylonitrile was dropped in the flask over a period of 1 hour. Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The mixture was then agitated for 3 hours at 90 to 100° C. to be subjected to radical polymerization. Thus, a resin 2 that is a methacrylic copolymer was prepared. The resin 2 had a weight average molecular weight of 34,000. The resin 2 was diluted with toluene so that the diluted solution had 25% by weight of nonvolatile contents. The diluted toluene solution of the resin 2 had a viscosity of 8.7 $mm^2/s$ and a specific weight of 0.90.

Resin Manufacturing Example 3

Monomer A:Monomer B:Monomer C=20:15:65

A flask equipped with a stirrer was charged with 300 g of toluene and heated to 90° C. under nitrogen gas flow. A mixture of 84.4 g (i.e., 200 mmol) of 3-methacryloxypropyl tris(trimethylsiloxy)silane represented by $CH_2{=}CMe\text{-}COO{-}C_3H_6{-}Si(OSiMe_3)_3$ (Me: methyl group) (SILAPLANE TM-0701T from Chisso Corporation), 39 g (i.e., 150 mmol) of 3-methacryloxypropylmethyl diethoxysilane, 65.0 g (i.e., 650 mmol) of methyl methacrylate, and 0.58 g (i.e., 3 mmol) of 2,2'-azobis-2-methylbutylonitrile was dropped in the flask over a period of 1 hour. Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The mixture was then agitated for 3 hours at 90 to 100° C. to be subjected to radical polymerization. Thus, a resin 3 that is a methacrylic copolymer was prepared. The resin 3 had a weight average molecular weight of 33,000. The resin 3 was diluted with toluene so that the diluted solution had 25% by weight of nonvolatile contents. The diluted toluene solution of the resin 3 had a viscosity of 8.8 $mm^2/s$ and a specific weight of 0.91.

Resin Manufacturing Example 4

Monomer A:Monomer B:Monomer C=20:15:65

The procedure for preparing the resin 3 was repeated except for replacing the 39 g (i.e., 150 mmol) of 3-methacryloxypropylmethyl diethoxysilane with 37.2 g (i.e., 150 mmol) of 3-methacryloxypropyl trimethoxysilane. Thus, a resin 4 that is a methacrylic copolymer was prepared. The resin 4 had a weight average molecular weight of 34,000. The resin 4 was diluted with toluene so that the diluted solution had 25% by weight of nonvolatile contents. The diluted toluene solution of the resin 4 had a viscosity of 8.7 $mm^2/s$ and a specific weight of 0.91.

Resin Manufacturing Example 5

Monomer A:Monomer B:Monomer C=25:15:60

The procedure for preparing the resin 3 was repeated except that the amounts of the 3-methacryloxypropyl tris (trimethylsiloxy)silane and methyl methacrylate were changed to 105.5 g (i.e., 250 mmol) and 60.0 g (i.e., 600 mmol), respectively. Thus, a resin 5 that is a methacrylic copolymer was prepared. The resin 5 had a weight average molecular weight of 34,000. The resin 5 was diluted with toluene so that the diluted solution had 25% by weight of nonvolatile contents. The diluted toluene solution of the resin 5 had a viscosity of 8.6 $mm^2/s$ and a specific weight of 0.91.

Resin Manufacturing Example 6

Monomer A:Monomer B:Monomer C=15:15:70

The procedure for preparing the resin 3 was repeated except that the amounts of the 3-methacryloxypropyl tris (trimethylsiloxy)silane and methyl methacrylate were changed to 63.3 g (i.e., 150 mmol) and 70.0 g (i.e., 700 mmol), respectively. Thus, a resin 6 that is a methacrylic copolymer was prepared. The resin 6 had a weight average molecular weight of 34,000. The resin 6 was diluted with toluene so that the diluted solution had 25% by weight of nonvolatile contents. The diluted toluene solution of the resin 6 had a viscosity of 8.9 $mm^2/s$ and a specific weight of 0.92.

Resin Manufacturing Example 7

Monomer A:Monomer B=100:0

A flask equipped with a stirrer was charged with 500 g of toluene and heated to 90° C. under nitrogen gas flow. A mixture of 422 g (i.e., 500 mmol) of 3-methacryloxypropyl tris(trimethylsiloxy)silane represented by $CH_2{=}CMe{-}COO{-}C_3H_6{-}Si(OSiMe_3)_3$ (Me: methyl group) (SILAPLANE TM-0701T from Chisso Corporation) and 0.58 g (i.e., 3 mmol) of 2,2'-azobis-2-methylbutylonitrile was dropped in the flask over a period of 1 hour. Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The mixture was then agitated for 3 hours at 90 to 100° C. to be subjected to radical polymerization. Thus, a resin 7 that is a methacrylic copolymer was prepared. The resin 7 had a weight average molecular weight of 37,000. The resin 7 was diluted with toluene so that the diluted solution had 25% by weight of nonvolatile contents. The diluted toluene solution of the resin 7 had a viscosity of 8.4 $mm^2/s$ and a specific weight of 0.91.

Resin Manufacturing Example 8

Monomer A:Monomer B=0:100

A flask equipped with a stirrer was charged with 500 g of toluene and heated to 90° C. under nitrogen gas flow. A mixture of 248.0 g (i.e., 1.000 mmol) of 3-methacryloxypropyl trimethoxysilane and 0.58 g (i.e., 3 mmol) of 2,2'-azobis-2-methylbutylonitrile was dropped in the flask over a period of 1 hour. Further, a solution of 0.06 g (i.e., 0.3 mmol) of 2,2'-azobis-2-methylbutylonitrole dissolved in 15 g of toluene was added to the flask. (The total amount of 2,2'-azobis-2-methylbutylonitrole was 0.64 g, i.e., 3.3 mmol.) The mixture was then agitated for 3 hours at 90 to 100° C. to be subjected to radical polymerization. Thus, a resin 8 that is a methacrylic copolymer was prepared. The resin 8 had a weight average molecular weight of 33,000. The resin 8 was diluted with toluene so that the diluted solution had 25% by weight of nonvolatile contents. The diluted toluene solution of the resin 8 had a viscosity of 8.7 $mm^2/s$ and a specific weight of 0.90.

Resin Manufacturing Example 9

A 500-ml flask equipped with a stirrer, a condenser, a thermometer, a nitrogen inlet pipe, and a dropping device was charged with 100 parts of MEK (methyl ethyl ketone). A solution in which 32.6 parts of MMA (methyl methacrylate), 2.5 parts of HEMA (2-hydroxyethyl methacrylate), 64.9 parts of MPTS (organopolysiloxane-1:3-methacryloxypropyl tris (trimethylsiloxy)silane), and 1 part of V-40 (1,1'-azobis(cyclohexane-1-carbonitrile)) were dissolved in 100 parts of MEK was dropped in the flask over a period of 2 hours at 80° C. under nitrogen gas flow. The mixture was subjected to aging for 5 hours. Thus, a resin 9 was prepared. The resin 9 was diluted with MEK so that the diluted solution had 25% by weight of nonvolatile contents.

Preparation of Conductive Particle

A suspension was prepared by dispersing 100 g of an aluminum oxide (AKP-30 from Sumitomo Chemical Co., Ltd.) in 1 liter of water, followed by heating at 70° C. A solution in which 11.6 g of tin(IV) chloride were dissolved in 1 liter of 2N hydrochloric acid and a 12% ammonia water were dropped in the suspension over a period of 40 minutes so that pH of the suspension became 7 to 8. Further, a solution in which 36.7 g of indium chloride and 5.4 g of tin(IV) chloride were dissolved in 450 ml of 2N hydrochloric acid and a 12% ammonia water were dropped in the suspension over a period of 1 hour so that pH of the suspension became 7 to 8. The suspension was then filtered and washed to obtain a cake. The cake was dried at 110° C. The resulting dried powder was treated at 500° C. for 1 hour under nitrogen gas flow. Thus, a conductive particle having a volume resistivity of 4 Ω·cm was prepared.

Carrier Manufacturing Example 1

A resin solution was prepared by diluting 100 parts of the resin 1, 4 parts of a catalyst, i.e., titanium diisopropoxybis (ethylacetoacetate) (TC-750 from Matsumoto Fine Chemical Co., Ltd.), and 2 parts of the conductive particle with toluene. The resin solution included 10% by weight of solid components. The resin solution was coated on the core particle 1 using a fluidized-bed-type coating device at 70° C. so that the resulting resin layer had an average thickness of 0.30 μm. The core particles having the resin coating was further burnt in an electric furnace at 180° C. for 2 hours. Thus, a carrier A was prepared.

Carrier Manufacturing Example 2

The procedure for preparing the carrier A in Carrier Manufacturing Example 1 was repeated except for replacing the resin 1 with the resin 2. Thus, a carrier B was prepared.

Carrier Manufacturing Example 3

The procedure for preparing the carrier A in Carrier Manufacturing Example 1 was repeated except for replacing the resin 1 with the resin 3. Thus, a carrier C was prepared.

Carrier Manufacturing Example 4

The procedure for preparing the carrier A in Carrier Manufacturing Example 1 was repeated except for replacing the resin 1 with the resin 4. Thus, a carrier D was prepared.

Carrier Manufacturing Example 5

The procedure for preparing the carrier A in Carrier Manufacturing Example 1 was repeated except for replacing the resin 1 with the resin 5. Thus, a carrier E was prepared.

Carrier Manufacturing Example 6

The procedure for preparing the carrier A in Carrier Manufacturing Example 1 was repeated except for replacing the resin 1 with the resin 6. Thus, a carrier F was prepared.

Carrier Manufacturing Example 7

The procedure for preparing the carrier A in Carrier Manufacturing Example 1 was repeated except for replacing the core particle C1 with the core particle C2. Thus, a carrier G was prepared.

Carrier Manufacturing Example 8

The procedure for preparing the carrier B in Carrier Manufacturing Example 2 was repeated except for replacing the core particle C1 with the core particle C2. Thus, a carrier H was prepared.

Carrier Manufacturing Example 9

The procedure for preparing the carrier C in Carrier Manufacturing Example 3 was repeated except for replacing the core particle C1 with the core particle C2. Thus, a carrier I was prepared.

Carrier Manufacturing Example 10

The procedure for preparing the carrier D in Carrier Manufacturing Example 4 was repeated except for replacing the core particle C1 with the core particle C2. Thus, a carrier J was prepared.

Carrier Manufacturing Example 11

The procedure for preparing the carrier E in Carrier Manufacturing Example 5 was repeated except for replacing the core particle C1 with the core particle C2. Thus, a carrier K was prepared.

Carrier Manufacturing Example 12

The procedure for preparing the carrier F in Carrier Manufacturing Example 6 was repeated except for replacing the core particle C1 with the core particle C2. Thus, a carrier L was prepared.

Carrier Manufacturing Example 13

The procedure for preparing the carrier A in Carrier Manufacturing Example 1 was repeated except for replacing the core particle C1 with the core particle C3. Thus, a carrier M was prepared.

Carrier Manufacturing Example 14

The procedure for preparing the carrier B in Carrier Manufacturing Example 2 was repeated except for replacing the core particle C1 with the core particle C3. Thus, a carrier N was prepared.

Carrier Manufacturing Example 15

The procedure for preparing the carrier C in Carrier Manufacturing Example 3 was repeated except for replacing the core particle C1 with the core particle C3. Thus, a carrier O was prepared.

Carrier Manufacturing Example 16

The procedure for preparing the carrier D in Carrier Manufacturing Example 4 was repeated except for replacing the core particle C1 with the core particle C3. Thus, a carrier P was prepared.

Carrier Manufacturing Example 17

The procedure for preparing the carrier E in Carrier Manufacturing Example 5 was repeated except for replacing the core particle C1 with the core particle C3. Thus, a carrier Q was prepared.

Carrier Manufacturing Example 18

The procedure for preparing the carrier F in Carrier Manufacturing Example 6 was repeated except for replacing the core particle C1 with the core particle C3. Thus, a carrier R was prepared.

Carrier Manufacturing Comparative Example 1

The procedure for preparing the carrier A in Carrier Manufacturing Example 1 was repeated except for replacing the resin 1 with the resin 7. Thus, a comparative carrier a was prepared.

Carrier Manufacturing Comparative Example 2

The procedure for preparing the carrier A in Carrier Manufacturing Example 1 was repeated except for replacing the resin 1 with the resin 8. Thus, a comparative carrier b was prepared.

Carrier Manufacturing Comparative Example 3

The procedure for preparing the carrier A in Carrier Manufacturing Example 1 was repeated except for replacing the resin 1 with the resin 9. Thus, a comparative carrier c was prepared.

Carrier Manufacturing Comparative Example 4

The procedure for preparing the carrier A in Carrier Manufacturing Example 1 was repeated except that 30 parts of a methyl silicone resin (having 25% of solid components) having a weight average molecular weight of 15,000 obtained from difunctional or trifunctional monomers were further added. Thus, a comparative carrier d was prepared.

Carrier Manufacturing Comparative Example 5

The procedure for preparing the carrier G in Carrier Manufacturing Example 7 was repeated except for replacing the resin 1 with the resin 7. Thus, a comparative carrier e was prepared.

Carrier Manufacturing Comparative Example 6

The procedure for preparing the carrier G in Carrier Manufacturing Example 7 was repeated except for replacing the resin 1 with the resin 8. Thus, a comparative carrier f was prepared.

Carrier Manufacturing Comparative Example 7

The procedure for preparing the carrier G in Carrier Manufacturing Example 7 was repeated except for replacing the resin 1 with the resin 9. Thus, a comparative carrier g was prepared.

Carrier Manufacturing Comparative Example 8

The procedure for preparing the carrier G in Carrier Manufacturing Example 7 was repeated except that 30 parts of a methyl silicone resin (having 25% of solid components) having a weight average molecular weight of 15,000 obtained from difunctional or trifunctional monomers were further added. Thus, a comparative carrier h was prepared.

Carrier Manufacturing Comparative Example 9

The procedure for preparing the carrier M in Carrier Manufacturing Example 13 was repeated except for replacing the resin 1 with the resin 7. Thus, a comparative carrier i was prepared.

Carrier Manufacturing Comparative Example 10

The procedure for preparing the carrier M in Carrier Manufacturing Example 13 was repeated except for replacing the resin 1 with the resin 8. Thus, a comparative carrier j was prepared.

Carrier Manufacturing Comparative Example 11

The procedure for preparing the carrier M in Carrier Manufacturing Example 13 was repeated except for replacing the resin 1 with the resin 9. Thus, a comparative carrier k was prepared.

Carrier Manufacturing Comparative Example 12

The procedure for preparing the carrier M in Carrier Manufacturing Example 13 was repeated except that 30 parts of a methyl silicone resin (having 25% of solid components) having a weight average molecular weight of 15,000 obtained from difunctional or trifunctional monomers were further added. Thus, a comparative carrier 1 was prepared.

Carrier Manufacturing Comparative Example 13

The procedure for preparing the carrier A in Carrier Manufacturing Example 1 was repeated except for replacing the core particle C1 with the core particle C4. Thus, a comparative carrier m was prepared.

Carrier Manufacturing Comparative Example 14

The procedure for preparing the carrier B in Carrier Manufacturing Example 2 was repeated except for replacing the core particle C1 with the core particle C4. Thus, a comparative carrier n was prepared.

Carrier Manufacturing Comparative Example 15

The procedure for preparing the carrier C in Carrier Manufacturing Example 3 was repeated except for replacing the core particle C1 with the core particle C4. Thus, a comparative carrier o was prepared.

Carrier Manufacturing Comparative Example 16

The procedure for preparing the carrier A in Carrier Manufacturing Example 1 was repeated except for replacing the core particle C1 with the core particle C5. Thus, a comparative carrier p was prepared.

Carrier Manufacturing Comparative Example 17

The procedure for preparing the carrier B in Carrier Manufacturing Example 2 was repeated except for replacing the core particle C1 with the core particle C5. Thus, a comparative carrier q was prepared.

Carrier Manufacturing Comparative Example 18

The procedure for preparing the carrier C in Carrier Manufacturing Example 3 was repeated except for replacing the core particle C1 with the core particle C5. Thus, a comparative carrier r was prepared.

The evaluation results of the core particles and carriers are respectively shown in Tables 1 and 2.

TABLE 1

| Core Particle Manufacturing Example No. | Core Particle Name | Shape Factor SF-2 | Weight Average Particle Diameter (μm) | Magnetization (emu/g) |
|---|---|---|---|---|
| 1 | C1 | 133 | 35.0 | 62 |
| 2 | C2 | 140 | 34.7 | 62 |
| 3 | C3 | 158 | 34.8 | 62 |
| 4 | C4 | 128 | 34.9 | 62 |
| 5 | C5 | 162 | 34.7 | 62 |

TABLE 2

| Carrier Manufacturing Example No. | Carrier Name | Core Particle Name | Covering Resin No. | Weight Average Particle Diameter (μm) | Magnetization (emu/g) | Volume Resistivity (LogR(Ω · m)) | Covering Resin Layer Thickness (μm) |
|---|---|---|---|---|---|---|---|
| 1 | A | C1 | 1 | 35.2 | 62 | 15.5 | 0.30 |
| 2 | B | C1 | 2 | 35.2 | 62 | 15.6 | 0.30 |
| 3 | C | C1 | 3 | 35.2 | 62 | 15.7 | 0.31 |
| 4 | D | C1 | 4 | 35.2 | 62 | 15.4 | 0.30 |
| 5 | E | C1 | 5 | 35.1 | 62 | 15.7 | 0.33 |

TABLE 2-continued

| Carrier Manufacturing Example No. | Carrier Name | Core Particle Name | Covering Resin No. | Weight Average Particle Diameter (μm) | Magnetization (emu/g) | Volume Resistivity (LogR(Ω · m)) | Covering Resin Layer Thickness (μm) |
|---|---|---|---|---|---|---|---|
| 6 | F | C1 | 6 | 35.0 | 62 | 15.4 | 0.30 |
| 7 | G | C2 | 1 | 34.9 | 62 | 15.7 | 0.33 |
| 8 | H | C2 | 2 | 34.9 | 62 | 15.4 | 0.30 |
| 9 | I | C2 | 3 | 34.9 | 62 | 15.6 | 0.29 |
| 10 | J | C2 | 4 | 34.9 | 62 | 15.5 | 0.31 |
| 11 | K | C2 | 5 | 35.0 | 62 | 15.3 | 0.29 |
| 12 | L | C2 | 6 | 35.0 | 62 | 15.5 | 0.30 |
| 13 | M | C3 | 1 | 35.0 | 62 | 15.7 | 0.31 |
| 14 | N | C3 | 2 | 35.0 | 62 | 15.4 | 0.30 |
| 15 | O | C3 | 3 | 35.0 | 62 | 15.3 | 0.29 |
| 16 | P | C3 | 4 | 35.0 | 62 | 15.5 | 0.30 |
| 17 | Q | C3 | 5 | 34.9 | 62 | 15.0 | 0.31 |
| 18 | R | C3 | 6 | 35.1 | 62 | 15.4 | 0.30 |
| Comp. 1 | a | C1 | 7 | 34.9 | 62 | 15.6 | 0.29 |
| Comp. 2 | b | C1 | 8 | 35.1 | 62 | 16.1 | 0.29 |
| Comp. 3 | c | C1 | 9 | 35.1 | 62 | 16.2 | 0.30 |
| Comp. 4 | d | C1 | Silicone Resin | 34.9 | 62 | 15.6 | 0.29 |
| Comp. 5 | e | C2 | 7 | 34.9 | 62 | 15.5 | 0.30 |
| Comp. 6 | f | C2 | 8 | 35.2 | 62 | 15.4 | 0.31 |
| Comp. 7 | g | C2 | 9 | 35.2 | 62 | 15.3 | 0.31 |
| Comp. 8 | h | C2 | Silicone Resin | 35.2 | 62 | 15.8 | 0.30 |
| Comp. 9 | i | C3 | 7 | 35.0 | 62 | 15.5 | 0.29 |
| Comp. 10 | j | C3 | 8 | 34.9 | 62 | 16.0 | 0.33 |
| Comp. 11 | k | C3 | 9 | 35.1 | 62 | 15.5 | 0.30 |
| Comp. 12 | l | C3 | Silicone Resin | 34.9 | 62 | 14.9 | 0.29 |
| Comp. 13 | m | C4 | 1 | 34.9 | 62 | 14.7 | 0.30 |
| Comp. 14 | n | C4 | 2 | 34.8 | 62 | 14.8 | 0.30 |
| Comp. 15 | o | C4 | 3 | 35.1 | 62 | 15.9 | 0.29 |
| Comp. 16 | p | C5 | 1 | 35.0 | 62 | 15.2 | 0.33 |
| Comp. 17 | q | C5 | 2 | 35.0 | 62 | 15.4 | 0.31 |
| Comp. 18 | r | C5 | 3 | 35.0 | 62 | 15.4 | 0.30 |

Shape Factors SF-2 of the core particles were measured by an image analyzer LUZEX III (from Nireco Corporation).

Weight average particle diameters of the core particles and carriers were measured by a Microtrac particle size analyzer HRA9320-X100 (from Nikkiso Co., Ltd.).

Magnetizations were measured by filling a measuring cell having an inner diameter of 2.4 mm and a height of 8.5 mm filled with about 0.15 g of each of the core particles and carriers, and subjecting them to measurement of magnetization in a magnetic field of 1 kOe using an instrument VSM-P7-15 (from Toei Industry Co., Ltd.).

Volume resistivity of each of the carriers was measured using a measuring cell illustrated in FIG. 1 as follows. The measuring cell was comprised of a fluorocarbon-resin container 2, in which electrodes 1*a* and 1*b* each having a surface area of 2.5 cm×4 cm were facing at a distance of 0.2 cm. The measuring cell was filled with a carrier 3 and tapped from a height of 1 cm for 10 times at a tapping speed of 30 times/min. Thereafter, a direct current voltage of 1,000 V was applied to between the electrodes 1*a* and 1*b* for 30 seconds to measure a resistance r (Ω) by a high resistance meter 4329A (from Hewlett-Packard Japan. Ltd.). A volume resistivity (Ω·cm) was calculated from the following equation:

$$r\times(2.5\times4)/0.2$$

The average thicknesses of the resin layers were measured by observing cross-sections of the carriers using a transmission electron microscope (TEM).

Weight average molecular weights of the resins were measured by a gel permeation chromatography and converted using standard polystyrenes. Viscosities of the resins were measured by a method according to JIS-K2283 at 25° C. Nonvolatile contents were calculated from the following equation:

$$\text{Nonvolatile content}(\%)=(W(2)-W(1))\times100/W(2)$$

wherein W(1) represents a weight of a sample which has been heated for 1 hour at 150° C. in an aluminum pan and W(2) represents a weight of the sample which has not been heated, i.e., 1 g.

Preparation of Toner

A reaction vessel equipped with a thermometer, a stirrer, a condenser, and a nitrogen inlet pipe was charged with 443 parts of a PO adduct of bisphenol A (having a hydroxyl value of 320), 135 parts of diethylene glycol, 422 parts of terephthalic acid, and 2.5 parts of dibutyltin oxide. The mixture was subjected to reaction at 200° C. until the acid value became 10. Thus, a polyester resin A was prepared. The polyester resin A had a glass transition temperature of 63° C. and a peak number average molecular weight of 6,000.

Another reaction vessel equipped with a thermometer, a stirrer, a condenser, and a nitrogen inlet pipe was charged with 443 parts of a PO adduct of bisphenol A (having a hydroxyl value of 320), 135 parts of diethylene glycol, 422 parts of terephthalic acid, and 2.5 parts of dibutyltin oxide. The mixture was subjected to reaction at 230° C. until the acid value became 7. Thus, a polyester resin B was prepared. The polyester resin B had a glass transition temperature of 65° C. and a peak number average molecular weight of 16,000.

Next, 40 parts of the polyester resin A, 60 parts of the polyester resin B, 1 part of a carnauba wax, and 15 parts of a carbon black (#44 from Mitsubishi Chemical Corporation)

were mixed for 3 minutes at 1,500 rpm by a HENSCHEL MIXER 20B (from Nippon Coke & Engineering Co., Ltd.). The mixture was kneaded by a single-axis kneader KONEADER (from Buss Corporation) while setting the inlet temperature to 100° C., the outlet temperature to 50° C., and the feed rate to 2 kg/hr. Thus, a mother toner A1 was prepared.

The mother toner A1 was then rolled and cooled, and pulverized into coarse particles by a pulverizer. The coarse particles were further pulverized into fine particles by an I-type mill (IDS-2 from Nippon Pneumatic Mfg. Co., Ltd.) using a flat collision plate while setting the air pressure to 6.8 atm/cm$^2$ and the feed rate to 0.5 kg/hr. The fine particles were classified by a classifier (132 MP from Alpine). Thus, a mother toner 1 was prepared.

The mother toner 1 in an amount of 100 parts was mixed with 1.0 part of a hydrophobized silica particle (R972 from Nippon Aerosil Co., Ltd.) by a HENSCHEL MIXER. Thus, a toner 1 was prepared.

Preparation of Developers

Each of the carriers A to R and a to r in an amount of 93 parts and the toner 1 (7.2 μm) in an amount of 7 parts were mixed for 20 minutes using a ball mill. Thus, developers A to R and a to r were prepared.

Evaluations of Developers

The developers were subjected to evaluation using a digital full-color multifunctional image forming apparatus IMAGIO COLOR 4000 (from Ricoh Co., Ltd.). Each of the developers A to R and a to r, and the toner 1 were set in the IMAGIO COLOR 4000, and a running test in which an image having an area occupancy of 20% was continuously produced on 300,000 sheets was performed. The initial charge quantity (Q1) and initial volume resistivity (R1) of the carrier before the running test and the charge quantity (Q2) and volume resistivity (R2) of the carrier after the 300,000th image was printed were measured to determine changes in charge quantity and volume resistivity.

The initial charge quantity (Q1) was measured by mixing 93 parts of each of the carriers A to R and a to r and 7 parts of the toner 1 so that the toner 1 was frictionally charged, and subjecting the mixture to a measurement using a blow off device (TB-200 from Toshiba Chemical Corporation). The charge quantity (Q2) of the carrier after the 300,000th image was printed was determined by measuring charge quantity of the developer from which toner particles were removed using a blow off device. A desired value of the charge quantity is 10 μC/g or less.

The initial volume resistivity (R1) was determined by measuring volume resistivity of each of the carriers A to R and a to r. The volume resistivity (R2) of the carrier after the 300,000th image was printed was determined by measuring volume resistivity of the developer from which toner particles were removed using a blow off device. A desired value of common logarithm of the volume resistivity LogR1 and LogR2 is 1.5 (Log(Ω·cm)) or less.

The evaluation results are shown in Table 3.

TABLE 3

| Carrier | | | Charge Quantity (−μC/g) | | | Volume Resistivity (Log(Ω · m)) | | |
|---|---|---|---|---|---|---|---|---|
| Manufacturing Example No. | Carrier Name | Developer Name | Q1 | Q2 | Q1 − Q2 | LogR1 | LogR2 | LogR1 − LogR2 |
| 1 | A | A | 37 | 32 | 5 | 15.5 | 15.0 | 0.5 |
| 2 | B | B | 40 | 36 | 4 | 15.6 | 14.9 | 0.7 |
| 3 | C | C | 44 | 37 | 7 | 15.7 | 14.9 | 0.8 |
| 4 | D | D | 38 | 33 | 5 | 15.4 | 14.7 | 0.7 |
| 5 | E | E | 37 | 33 | 4 | 15.7 | 15.1 | 0.6 |
| 6 | F | F | 40 | 35 | 5 | 15.4 | 14.6 | 0.8 |
| 7 | G | G | 45 | 44 | 1 | 15.6 | 15.4 | 0.2 |
| 8 | H | H | 38 | 36 | 2 | 15.5 | 15.3 | 0.2 |
| 9 | I | I | 40 | 37 | 3 | 15.7 | 15.6 | 0.1 |
| 10 | J | J | 44 | 42 | 2 | 15.3 | 15.6 | −0.3 |
| 11 | K | K | 45 | 43 | 2 | 15.3 | 15.0 | 0.3 |
| 12 | L | L | 38 | 37 | 1 | 15.5 | 15.7 | −0.2 |
| 13 | M | M | 39 | 34 | 5 | 15.8 | 16.4 | −0.6 |
| 14 | N | N | 40 | 36 | 4 | 15.5 | 16.1 | −0.6 |
| 15 | O | O | 38 | 31 | 7 | 14.9 | 15.4 | −0.5 |
| 16 | P | P | 36 | 31 | 5 | 15.8 | 16.2 | −0.4 |
| 17 | Q | Q | 40 | 36 | 4 | 14.9 | 15.6 | −0.7 |
| 18 | R | R | 42 | 37 | 5 | 15.5 | 16.1 | −0.6 |
| Comp. 1 | a | a | 47 | 37 | 10 | 16.1 | 17.1 | −1.0 |
| Comp. 2 | b | b | 38 | 31 | 7 | 16.2 | 17.3 | −1.1 |
| Comp. 3 | c | c | 37 | 29 | 9 | 15.6 | 16.9 | −1.3 |
| Comp. 4 | d | d | 40 | 32 | 8 | 15.0 | 16.2 | −1.2 |
| Comp. 5 | e | e | 37 | 24 | 13 | 15.4 | 16.9 | −1.5 |
| Comp. 6 | f | f | 38 | 25 | 13 | 15.3 | 16.4 | −1.1 |
| Comp. 7 | g | g | 37 | 20 | 17 | 15.8 | 17.3 | −1.5 |
| Comp. 8 | h | h | 38 | 25 | 13 | 15.5 | 16.9 | −1.4 |
| Comp. 9 | i | i | 37 | 20 | 17 | 15.4 | 16.8 | −1.4 |
| Comp. 10 | j | j | 35 | 21 | 14 | 16.1 | 17.3 | −1.2 |
| Comp. 11 | k | k | 33 | 18 | 15 | 16.2 | 17.6 | −1.4 |
| Comp. 12 | l | l | 36 | 20 | 16 | 15.6 | 16.9 | −1.3 |
| Comp. 13 | m | m | 39 | 36 | 3 | 15.0 | 13.6 | 1.4 |
| Comp. 14 | n | n | 40 | 34 | 6 | 15.4 | 13.9 | 1.5 |
| Comp. 15 | o | o | 42 | 39 | 3 | 14.9 | 13.4 | 1.5 |
| Comp. 16 | p | p | 41 | 39 | 2 | 15.5 | 17.0 | −1.5 |
| Comp. 17 | q | q | 42 | 38 | 1 | 14.7 | 17.2 | −1.5 |
| Comp. 18 | r | r | 38 | 37 | 1 | 15.4 | 17.0 | −1.6 |

The developers were further subjected to the following image evaluations and reliability tests using a digital full-color multifunctional image forming apparatus IMAGIO COLOR 4000 (from Ricoh Co., Ltd.) under the following developing conditions.

Developing gap (i.e., a distance between photoreceptor and developing sleeve): 0.3 mm Doctor gap (i.e., a distance between developing sleeve and doctor blade): 0.65 mm Linear speed of photoreceptor: 200 mm/sec (Linear speed of developing sleeve)/(Linear speed of photoreceptor): 1.80

Writing density: 600 dpi

Charged potential (Vd): −600 V

Solid image potential after irradiation: −100 V

Developing bias: DC −500 V/alternating current bias component: 2 kHz, −100 to −900 V, 50% duty Granularity Granularity (brightness range: 50-80) of the resulting image formed on paper was determined from the following equation and graded into four levels.

$$\text{Granularity}=\exp(aL+b)\int(WS(f))1/2\cdot VTF(f)df$$

wherein L represents an average brightness, f represents a spatial frequency (cycle/mm), WS(f) represents a power spectrum of brightness variation, VTF(f) represents a spatial frequency characteristic of vision, and each of a and b represents a coefficient.

A (Very good): Not less than 0 and less than 0.2

B (Good): Not less than 0.2 and less than 0.3

C (Usable): Not less than 0.3 and less than 0.4

D (Not usable): Not less than 0.4

Background Fouling

The resulting image formed on paper was visually observed to determine whether background portion had fouling or not. The conditions were graded into the following four levels.

A (Very good)

B (Good)

C (Usable)

D (Not usable)

Carrier Deposition in Solid Portions

Carrier particles undesirably deposited on image may make scratches on photoreceptor and fixing roller and degrade the resulting image quality. Even when carrier particles are deposited on photoreceptor, only a part of the carrier particles are to be transferred onto paper. Thus, the degree of carrier deposition was evaluated as follows.

The solid image (30 mm×30 mm) formed on the photoreceptor under the above-described developing condition in which the charged potential (Vd) was −600 V, the irradiated portion (solid image portion) potential was −100V, and the developing bias DC was −500 V, was transferred onto an adhesive tape. The number of carrier particles adhered to the tape was visually counted to determine the degree of carrier deposition. The conditions were graded into the following four levels.

A (Very good)

B (Good)

C (Usable)

D (Not usable)

Carrier Deposition in Edge Portions

Carrier particles undesirably deposited on image may make scratches on photoreceptor and fixing roller and degrade the resulting image quality. Even when carrier particles are deposited on photoreceptor, only a part of the carrier particles are to be transferred onto paper. Thus, the degree of carrier deposition was evaluated as follows.

A 2-dot-line image (100 lpi) was formed on the photoreceptor in the vertical scanning direction under a developing condition in which the charged potential (Vd) was −600 V, the irradiated portion potential was −100 V, the developing bias (Vb) DC was −400 V, and the background potential was −200 V. The 2-dot-line image was transferred onto an adhesive tape (having an area of 100 $cm^2$). The number of carrier particles adhered to the tape was visually counted to determine the degree of carrier deposition. The conditions were graded into the following four levels.

A (Very good)

B (Good)

C (Usable)

D (Not usable)

Environmental Variation in Image Density

Environmental variation in image density was determined from the difference between the image density at 30° C., 90% RH and that at 10° C., 15% RH and graded into the following four levels.

A (Very good): Not less than 0 and less than 0.05

B (Good): Not less than 0.05 and less than 0.15

C (Usable): Not less than 0.15 and less than 0.25

D (Not usable): Not less than 0.25

Toner Scattering

Periphery of the developing device was visually observed after the running test to determine the degree of toner scattering. The conditions were graded into the following four levels.

A (Very good)

B (Good)

C (Usable)

D (Not usable)

The results at the initial stage and after the running test were respectively shown in Tables 4 and 5.

TABLE 4

| | | | Evaluation Results at Initial Stage | | | |
|---|---|---|---|---|---|---|
| Carrier Manufacturing Example No. | Carrier Name | Developer Name | Granularity | Background Fouling | Carrier Deposition (Solid Portion) | Carrier Deposition (Edge Portion) |
| 1 | A | A | A | B | A | A |
| 2 | B | B | B | B | B | B |
| 3 | C | C | B | A | A | A |
| 4 | D | D | A | B | A | A |
| 5 | E | E | A | A | B | A |
| 6 | F | F | B | A | A | A |
| 7 | G | G | B | A | A | B |

TABLE 4-continued

| Carrier Manufacturing Example No. | Carrier Name | Developer Name | Evaluation Results at Initial Stage | | | |
|---|---|---|---|---|---|---|
| | | | Granularity | Background Fouling | Carrier Deposition (Solid Portion) | Carrier Deposition (Edge Portion) |
| 8 | H | H | B | A | A | A |
| 9 | I | I | A | A | A | A |
| 10 | J | J | A | A | A | B |
| 11 | K | K | B | A | B | B |
| 12 | L | L | A | A | A | A |
| 13 | M | M | B | A | A | B |
| 14 | N | N | B | B | A | B |
| 15 | O | O | A | A | A | B |
| 16 | P | P | A | B | A | A |
| 17 | Q | Q | B | B | B | B |
| 18 | R | R | B | A | B | B |
| Comp. 1 | a | a | B | A | A | B |
| Comp. 2 | b | b | B | B | A | B |
| Comp. 3 | c | c | B | A | B | B |
| Comp. 4 | d | d | A | B | A | A |
| Comp. 5 | e | e | B | A | B | B |
| Comp. 6 | f | f | A | B | A | A |
| Comp. 7 | g | g | B | B | B | B |
| Comp. 8 | h | h | B | A | B | B |
| Comp. 9 | i | i | B | B | A | B |
| Comp. 10 | j | j | B | B | A | B |
| Comp. 11 | k | k | B | B | B | A |
| Comp. 12 | l | l | A | B | A | A |
| Comp. 13 | m | m | B | B | B | B |
| Comp. 14 | n | n | B | A | B | B |
| Comp. 15 | o | o | B | B | B | B |
| Comp. 16 | p | p | B | A | B | B |
| Comp. 17 | q | q | A | B | A | A |
| Comp. 18 | r | r | B | A | B | B |

TABLE 5

| Carrier Manufacturing Example No. | Carrier Name | Developer Name | Evaluation Results After Running Rest (300,000 sheets printed) | | | | | |
|---|---|---|---|---|---|---|---|---|
| | | | Granularity | Background Fouling | Carrier Deposition (Solid Portion) | Carrier Deposition (Edge Portion) | Environmental Variation in ID | Toner Scattering |
| 1 | A | A | B | B | A | B | B | B |
| 2 | B | B | B | B | A | B | B | B |
| 3 | C | C | A | A | A | B | B | B |
| 4 | D | D | A | A | A | B | B | B |
| 5 | E | E | B | B | A | B | A | A |
| 6 | F | F | B | B | A | B | B | B |
| 7 | G | G | B | B | A | A | A | A |
| 8 | H | H | B | B | A | A | A | B |
| 9 | I | I | A | A | A | A | A | A |
| 10 | J | J | A | A | A | A | B | B |
| 11 | K | K | B | B | A | A | B | B |
| 12 | L | L | B | B | A | A | B | B |
| 13 | M | M | A | B | B | A | B | B |
| 14 | N | N | A | B | B | A | B | B |
| 15 | O | O | A | A | B | A | B | A |
| 16 | P | P | B | A | B | A | B | A |
| 17 | Q | Q | A | B | B | A | B | A |
| 18 | R | R | A | B | B | A | B | A |
| Comp. 1 | a | a | B | C | C | B | D | D |
| Comp. 2 | b | b | B | C | C | B | D | D |
| Comp. 3 | c | c | B | D | D | B | D | D |
| Comp. 4 | d | d | B | D | D | B | D | D |
| Comp. 5 | e | e | B | C | C | B | D | D |
| Comp. 6 | f | f | B | C | C | B | D | D |
| Comp. 7 | g | g | B | D | D | B | D | D |
| Comp. 8 | h | h | B | D | D | B | D | D |
| Comp. 9 | i | i | B | C | C | B | D | D |

TABLE 5-continued

| Carrier Manufacturing Example No. | Carrier Name | Developer Name | Evaluation Results After Running Rest (300,000 sheets printed) Granularity | Background Fouling | Carrier Deposition (Solid Portion) | Carrier Deposition (Edge Portion) | Environmental Variation in ID | Toner Scattering |
|---|---|---|---|---|---|---|---|---|
| Comp. 10 | j | j | B | C | C | B | D | D |
| Comp. 11 | k | k | B | D | D | B | D | D |
| Comp. 12 | l | l | B | D | D | B | D | D |
| Comp. 13 | m | m | B | B | B | D | B | B |
| Comp. 14 | n | n | B | B | B | D | B | B |
| Comp. 15 | o | o | B | B | B | D | B | B |
| Comp. 16 | p | p | B | B | B | B | D | B |
| Comp. 17 | q | q | B | B | B | B | D | B |
| Comp. 18 | r | r | B | B | B | B | D | |

What is claimed is:

1. A carrier for developing an electrostatic latent image, comprising:

a magnetic core particle having a shape factor SF-2 of 130 to 160; and a resin layer covering a surface of the magnetic core particle, the resin layer comprising a conductive particle and a resin obtained by heating a copolymer comprising a monomer A unit having the following formula (1) and a monomer B unit having the following formula (2):

(1)

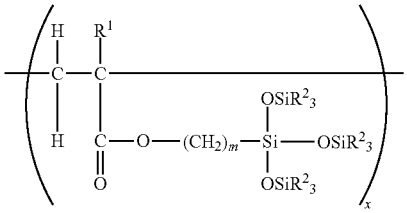

Monomer A unit (2)

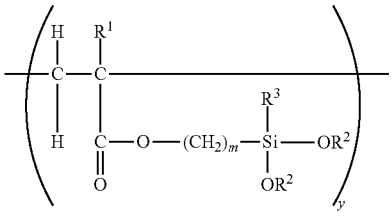

Monomer B unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, and each of X and Y represents a molar ratio (%) between 10 to 90.

2. The carrier according to claim 1, the copolymer comprising a copolymer having the following formula (5):

(5)

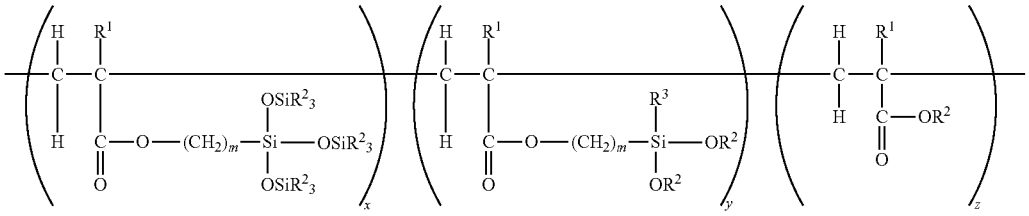

Monomer A unit Monomer B unit Monomer C unit wherein $R^1$ represents a hydrogen atom or a methyl group, m represents an integer of 1 to 8, $R^2$ represents an alkyl group having 1 to 4 carbon atoms, $R^3$ represents an alkyl group having 1 to 8 carbon atoms or an alkoxy group having 1 to 4 carbon atoms, each of X and Y represents a molar ratio (%) of 10 to 40, Z represents a molar ratio (%) of 30 to 80, and $60<Y+Z<90$ is satisfied.

3. The carrier according to claim 1, the copolymer being heated at 80 to 400° C.

4. The carrier according to claim 1, the carrier having a volume resistivity of $1\times10^7$ to $1\times10^{17}$ Ω·cm.

5. The carrier according to claim 1, the resin layer having an average thickness of 0.05 to 0.50 μm.

6. The carrier according to claim 1, the core particle having a weight average particle diameter of 20 to 65 μm.

7. The carrier according to claim 1, the carrier having a magnetization of 40 to 90 $Am^2/kg$ in a magnetic field of 1 kOe.

8. A two-component developer, comprising the carrier according to claim 1 and a toner.

9. The two-component developer according to claim 8, the toner being a toner for forming a full-color image.

10. A supplemental developer, comprising:

the carrier according to claim 1 in an amount of 1 part by weight; and a toner in an amount of 2 to 50 parts by weight.

11. An image forming method, comprising:

forming an electrostatic latent image on an electrostatic latent image bearing member;

developing the electrostatic latent image into a toner image with the developer according to claim 8 transferring the toner image from the electrostatic latent image bearing member onto a recording medium; and fixing the toner image on the recording medium.

12. The carrier according to claim 1, wherein each of X and Y represents a molar ratio (%) between 30 and 70.

13. The carrier according to claim 3, wherein each of X and Y represents a molar ratio (%) between 30 and 70.

14. The carrier according to claim 4, wherein each of X and Y represents a molar ratio (%) between 30 and 70.

15. The carrier according to claim 5, wherein each of X and Y represents a molar ratio (%) between 30 and 70.

16. The carrier according to claim 6, wherein each of X and Y represents a molar ratio (%) between 30 and 70.

17. The carrier according to claim 7, wherein each of X and Y represents a molar ratio (%) between 30 and 70.

18. The carrier according to claim 2, wherein each of X and Y represents a molar ratio (%) of 10 to 40, Z represents a molar ratio (%) of 35 to 75, and $70<Y+Z<85$ is satisfied.

* * * * *

UNITED STATES PATENT AND TRADEMARK OFFICE

CERTIFICATE OF CORRECTION

PATENT NO. : 8,512,928 B2
APPLICATION NO. : 13/226219
DATED : August 20, 2013
INVENTOR(S) : Hiroyuki Kishida et al.

It is certified that error appears in the above-identified patent and that said Letters Patent is hereby corrected as shown below:

On the title page, Item (73), the Assignee information is incorrect. Item (73) should read:

-- (73) Assignee: Ricoh Company, Ltd., Tokyo (JP) --

Signed and Sealed this
Twenty-second Day of October, 2013

Teresa Stanek Rea
*Deputy Director of the United States Patent and Trademark Office*